US007240460B2

(12) United States Patent
Platt

(10) Patent No.: US 7,240,460 B2
(45) Date of Patent: Jul. 10, 2007

(54) MOLDING FOR DRYWALL CEILING GRID

(75) Inventor: William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 368 days.

(21) Appl. No.: 10/890,436

(22) Filed: Jul. 14, 2004

(65) Prior Publication Data

US 2006/0010811 A1 Jan. 19, 2006

(51) Int. Cl.
*E04B 9/00* (2006.01)

(52) U.S. Cl. ..... 52/506.07; 52/506.06

(58) Field of Classification Search ..... 52/506.06, 52/506.07, 664, 512, 506.1, 716.1, 287.1, 52/718.04, 733.1, 220.6
See application file for complete search history.

(56) References Cited

U.S. PATENT DOCUMENTS 2,710,679 A * 6/1955 Bibb et al. ..... 403/217
2,964,148 A * 12/1960 Jacobson ..... 52/281
4,055,930 A * 11/1977 Weinar et al. ..... 52/718.01
4,406,104 A 9/1983 Beck et al.
4,586,841 A 5/1986 Hunter
5,619,833 A * 4/1997 Neff ..... 52/506.07
5,979,134 A * 11/1999 Neff ..... 52/506.07
6,516,581 B2 2/2003 Paul et al.
6,516,582 B2 2/2003 Paul et al.
6,722,098 B2 4/2004 Platt

FOREIGN PATENT DOCUMENTS

AU 2493871 8/1972

* cited by examiner

*Primary Examiner*—Elizabeth A. Plummer
(74) *Attorney, Agent, or Firm*—Eugene Chovanes

(57) ABSTRACT

A wall molding for a drywall ceiling grid having a vertical leg that is attached to a wall, and a horizontal ledge that supports a beam extending outwardly from the wall, with the ledge having a pair of tabs and a ratchet tooth at regular intervals along the ledge that position and secure the beam end to the ledge.

23 Claims, 6 Drawing Sheets

43
3
45
42
51
52
55
3
40
61
53
57
50

50
56
42
68
69
61
55
65
63
53
58
62
40
5
70
68
43

MOLDING FOR DRYWALL CEILING GRID

BACKGROUND OF THE INVENTION (1) Field of the Invention

The invention is in the field of drywall interior ceilings.

Preformed panels of drywall, sometimes called plasterboard, are affixed by self-tapping screws to a metallic grid suspended below a structural ceiling. The screws pass through flanges of beams in the grid.

In short spans of ceiling, the beams are suspended only on a molding extending along the walls. On long spans of ceiling, the beams are also suspended between the walls by wires embedded in the structural ceiling.

(2) The Prior Art

There is shown in U.S. Pat. No. 6,722,098, incorporated herein by reference, a beam for a grid in a ceiling that has panels of drywall affixed to the ceiling grid by self-tapping screws. Such beams generally extend from wall to wall in a room, and rest on a wall molding having a right angle in its cross section, with the vertical leg of the angle affixed to the wall, and a horizontal ledge extending from the wall.

The end of a beam rests on the ledge and is affixed to the ledge by, for instance, a self-tapping screw.

It is important that the beams be accurately spaced, and parallel to one another at, for instance, a 4' distance, since the panels are generally 4'×8' in dimension, and it is necessary for the edge of a panel to be positioned directly below a beam for attachment thereto.

Additional beams are also generally located at regular intervals, between, and parallel to, the four foot spaced beams, to provide more beams to which the panels can be attached.

Generally, no hanging support wires are used where the ceiling is relatively of a short span between walls, as in a corridor. Hanging wire supports, extending from the structural ceiling to the beams, as well-known, are generally used where the spans are, for instance, 8 ft. or more.

In placing the ends of the beams on the wall molding ledge, much time and effort are expended in accurately positioning the beams along the ledge, and in securing the beam to the ledge. First, it is necessary to measure along the molding to locate the beam. Then, a self-tapping screw is manually inserted through the ledge and beam flange at one end of the beam. This requires the installer to hold the beam to the ledges until the screw, which is inserted from below, pierces through the flange. The screw then must be turned until the threads of the screw seat the head of the screw against the bottom of the ledge. Then, the operation is repeated at the other end of the beam. The procedure is repeated throughout the length of the ceiling.

SUMMARY OF THE PRESENT INVENTION

The wall molding of the present invention provides a quick and accurate way of positioning, and securing, the end of a beam that has hems along flanges of the beam. Such beams are depicted in the '098 patent. The beams are positioned along, and secured to, the ledge of a wall molding having a right angle section, in a ceiling grid for a drywall suspended ceiling.

The wall molding of the present invention is formed with a pair of retaining tabs, regularly spaced along the molding, lanced from the horizontal ledge of the molding while the molding is being rollformed, brake formed, or otherwise formed. The pair of tabs work jointly, along with a single ratchet tooth on the ledge in one embodiment, or two ratchet teeth in another embodiment, to position and lock the beam flanges to the ledge, by a single back and forth motion. The flanges are held downwardly against the ledge by the tabs, which are spring biased downwardly.

In a first embodiment of the invention, a first flange on a beam is manually rearwardly slid under a hold-down tab until a second, oppositely extending, flange on the beam clears a forwardly positioned locking tab on the ledge. The motion of the beam is then reversed to move the second flange on the beam under the locking tab. The second flange, with its downwardly extending hem, as disclosed in the '098 patent, passes over a ratchet tooth in the ledge, alongside the locking tab, whereby the locking tab secures the second flange to the molding ledge and the ratchet tooth on the ledge prevents rearward movement, with both the first flange and second flange held downward in contact with the ledge by the downward spring bias of the tabs.

In another embodiment, each tab is associated with a ratchet tooth.

In still another embodiment, the ratchet teeth are formed in the tabs. The teeth engage an upward and inward extending hem. Such a beam is shown as prior art in the '098 patent. The beam has a separate bottom cap, that extends over the flanges, and that has an upward and inwardly extending hem that holds the cap to the flanges.

All embodiments of the invention use the concept of tabs and ratchet teeth that hold down and lock the flanges to the molding ledge.

By the above-described action, the beam is locked to the wall molding at a predetermined position along the molding, in a quick and relatively easy manner.

The opposite end of the beam is likewise positioned and locked to the wall molding on the opposing wall. The moldings are placed in exact opposite registry, so that the beams are positioned and secured at right angles to the wall, parallel to one another, at selected, regularly spaced, intervals. The panels are then affixed to the beams, as shown in the '098 patent, by self-tapping screws.

The wall moldings can be rollformed, brake formed, or otherwise repetitively formed, as well-known in the prior art, and the hold-down and locking tabs, as well as the ratchet teeth, are lanced from the molding ledge during these processes.

DESCRIPTION OF THE PREFERRED EMBODIMENT

Figure 1:
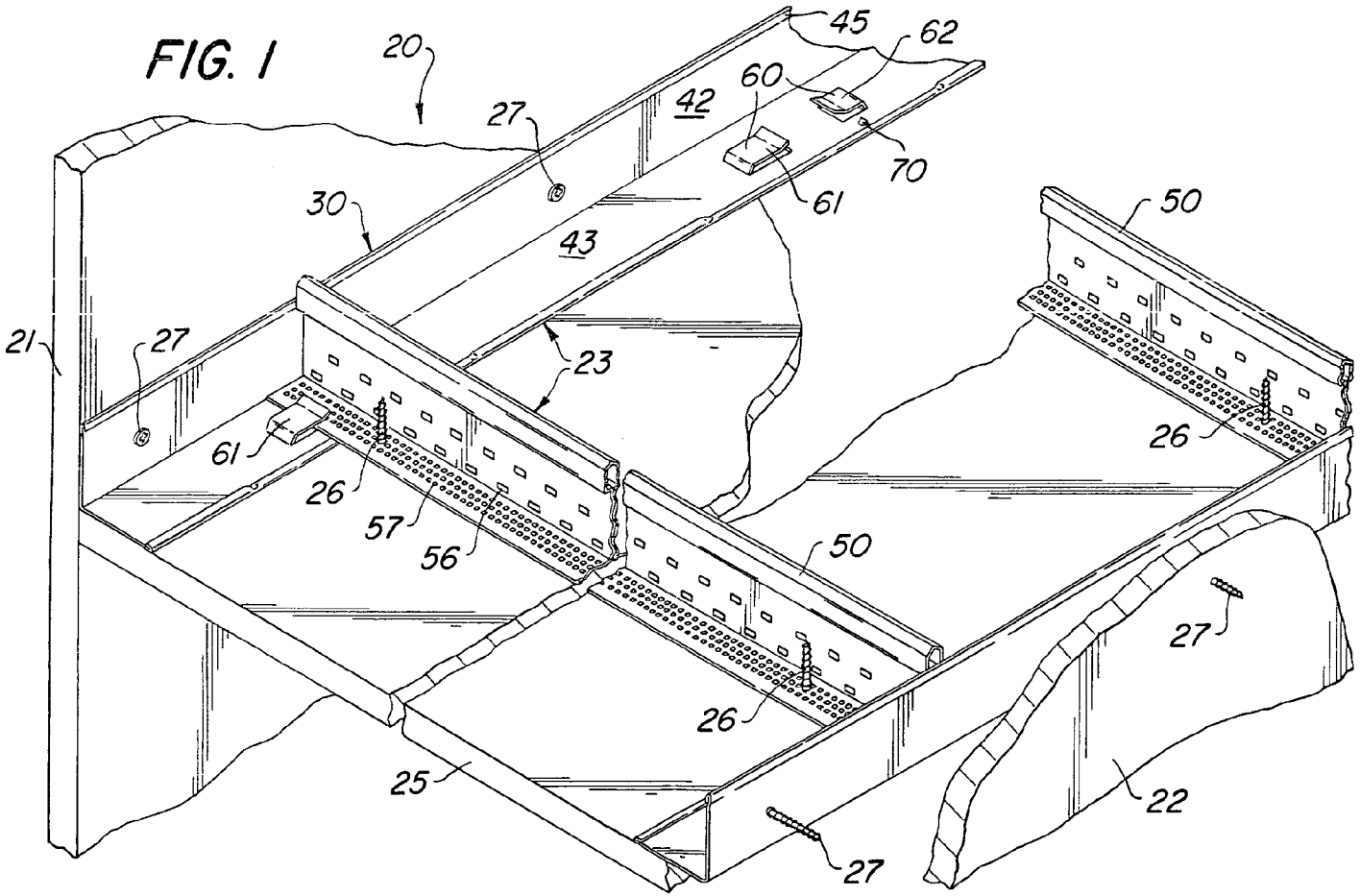
FIG. 1 is a fragmented perspective view, from above, of a suspended drywall ceiling extending between opposing walls, showing a first embodiment of the invention.

As seen in FIG. 1, a drywall ceiling 20 extends between opposing vertical room walls 21 and 22. The drywall ceiling 20 includes grid 23 having attached thereto panels 25 by self-tapping screws 26. The grid 23 includes wall molding 30 and beams 50. Molding 30 is secured to walls 21 and 22 by self-tapping screws 27.

The wall moldings, as seen in the FIGS. 1 through 7, have spaced along the beam a pair 60 of opposing tabs 61 and 62. Tab 61 forms a hold-down tab wherein a tongue 63 is lanced from the ledge 43. Tongue 63 is biased downwardly toward the ledge. The hold-down tab 61 is integral with the ledge 43 at its pivot line 65 and then has a straight section 68 and an upturned section 69.

Positioned opposite to hold-down tab 61 is locking tab 62. Tab 62 is similar to tab 61 except the straight section 68 is shorter. Alongside the locking tab 62 is a ratchet tooth 70 which has a slope extending away from the hold-down tab 61, toward the pivot line 71 of locking tab 67.

A typical wall molding may have a vertical leg 42 and a ledge 43, each 1¼" wide. Each of the tabs may be ½" wide in a direction across the molding 40 and with a space of about ⅘" between opposing tabs 61 and 62 in a pair 60. The distance between the pivot lines 65 and 71 of the tabs 60 may be about 2". A hem 45 is optionally along the edge of the molding.

In some instances, it may be desired to use a channel wall molding that is U-shaped in cross section, wherein the base of the U is attached vertically to the wall, and one of the legs of the U acts as a horizontal ledge. The present invention, as described in the drawings, in effect uses an angle formed of the base and a leg of the channel in the manner described to achieve the desired result.

The beam 50 is engaged with the pair of tabs 60 and ratchet tooth 70 as seen in FIGS. 2 through 7.

Figure 2:
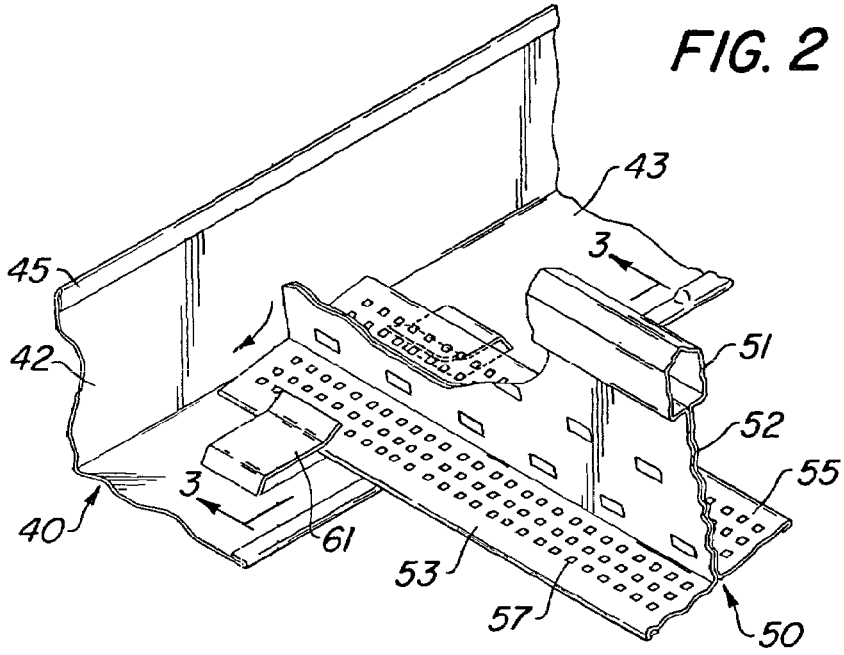
FIG. 2 is a fragmented perspective view, taken from above, of the first flange of a beam being inserted under the rear hold-down tab of the connection, to form the embodiment of the invention shown in FIG. 1.
Figure 3:
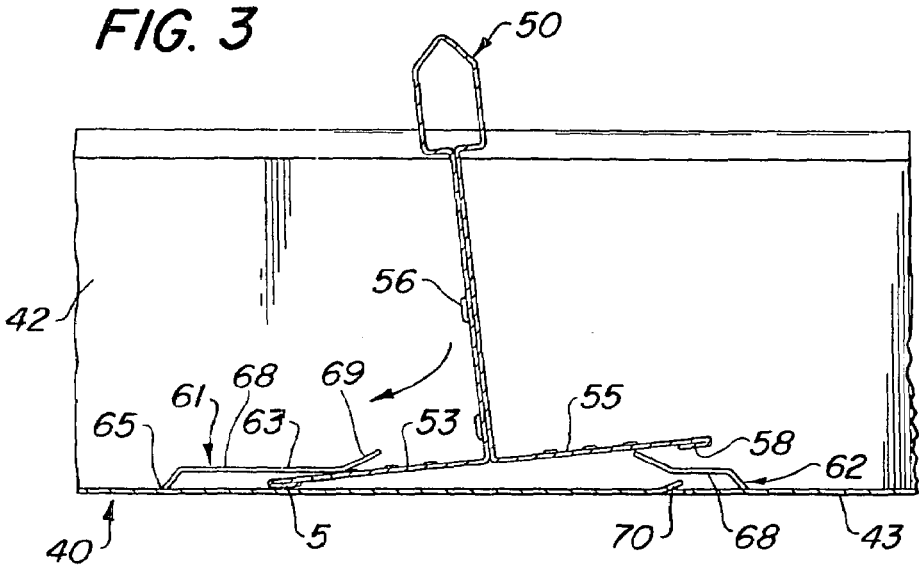
FIG. 3 is a cross-sectional view taken of the line 3—3 of FIG. 2.

In FIGS. 2 and 3, the first flange 53 of beam 50 is engaged under hold-down tab 61 as shown. In this position, the beam 50 with flanges 53 and 55, and web 52 is angled so that first flange 53 can engage under the locking tab 62 as shown. Second flange 55 bears on top of locking tab 62.

Both hold-down tab 61 and locking tab 62 have a downward bias in the form of a spring action that results when the tabs are lanced out of the steel web stock from which the angle moldings are formed. The forming of angle molding by rollforming, and the steel used in the web from which the molding is formed, is well-known in the prior art.

Figure 4:
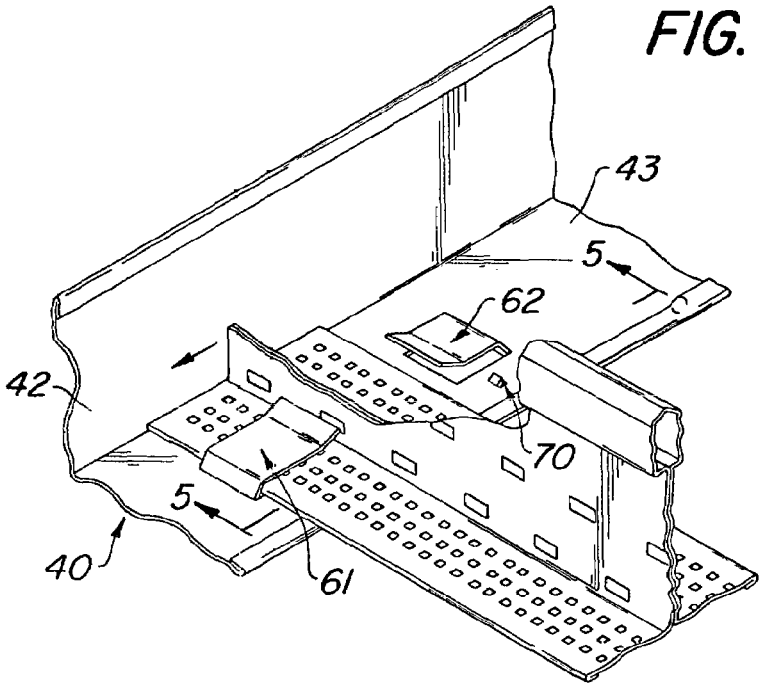
FIG. 4 is a fragmented perspective view, similar to FIG. 2, from above, showing the beam resting on the molding ledge, positioned fully rearward under the rear hold-down tab.
Figure 5:
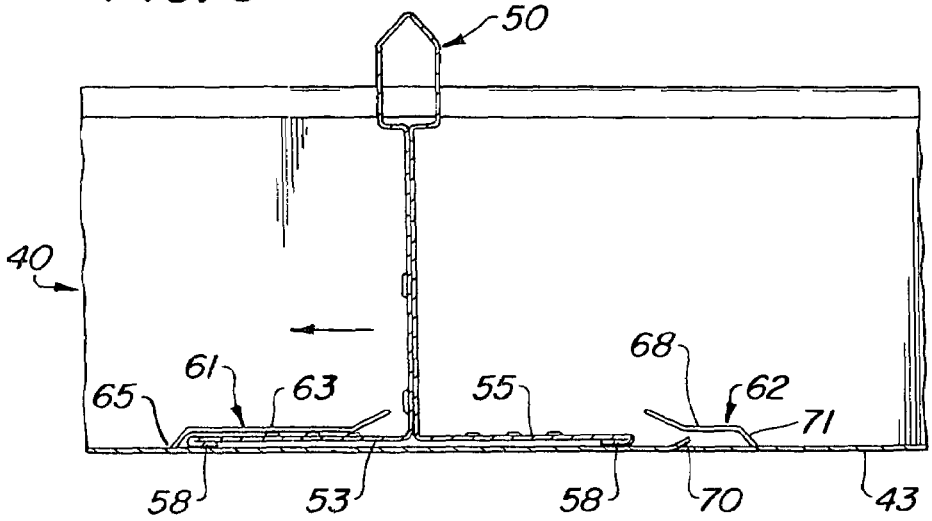
FIG. 5 is a cross-sectional view, similar to FIG. 3, taken on the line 5—5 of FIG. 4.

As seen in FIGS. 4 and 5, first flange 53 has been slid completely under hold-down tab 61, and second flange 55 has cleared locking tab 62. Flanges 53 and 55 rest on ledge 43 and are held thereto by spring biasing action of tab 61. Hems 58 at the bottom of the flanges 53 and 55 are in contact with ledge 43.

As seen in FIGS. 4 and 5, the hold-down tab 61 must have a length deep enough to permit the first flange 53 to slide rewardly enough to permit the second flange 55 to clear locking tab 68.

Figure 6:
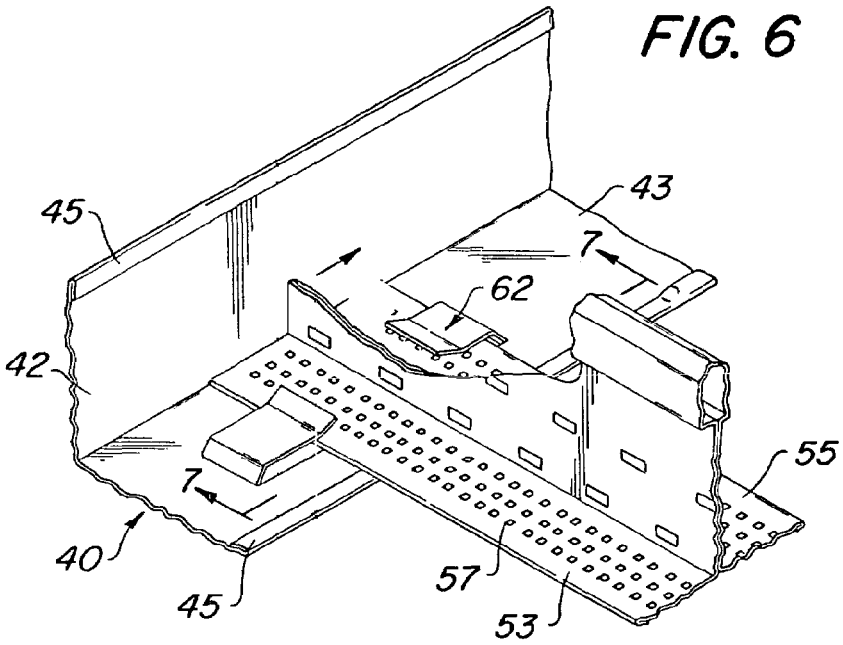
FIG. 6 is a fragmentary perspective view, similar to FIGS. 2 and 4, showing the beam moved fully forward on the ledge, beneath the hold-down and locking tabs, with the hem of the forward flange engaged with the ratchet tooth on the molding ledge, locking the beam in a forward position beneath the hold-down and locking tabs.
Figure 7:
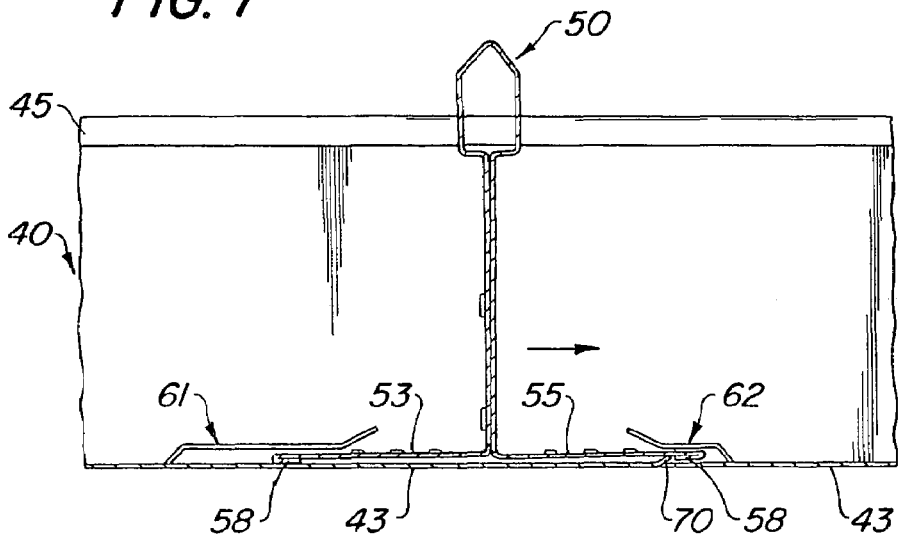
FIG. 7 is a view similar to FIGS. 3 and 5, taken on the line 7—7 of FIG. 6.

As seen in FIGS. 6 and 7, beam 50, with flanges 53 and 55, is slid forward under locking tab 62 until hem 58 on the underside of flange 55 passes up over ratchet tooth 70. Second flange 55 is then forced downward against ledge 43 by locking tab 62, whereby the flange is locked in place from forward or rearward movement on ledge 43. Hold-down tab 61, as seen in FIGS. 6 and 7, holds down the first flange 53 against the ledge 43.

Figure 8:
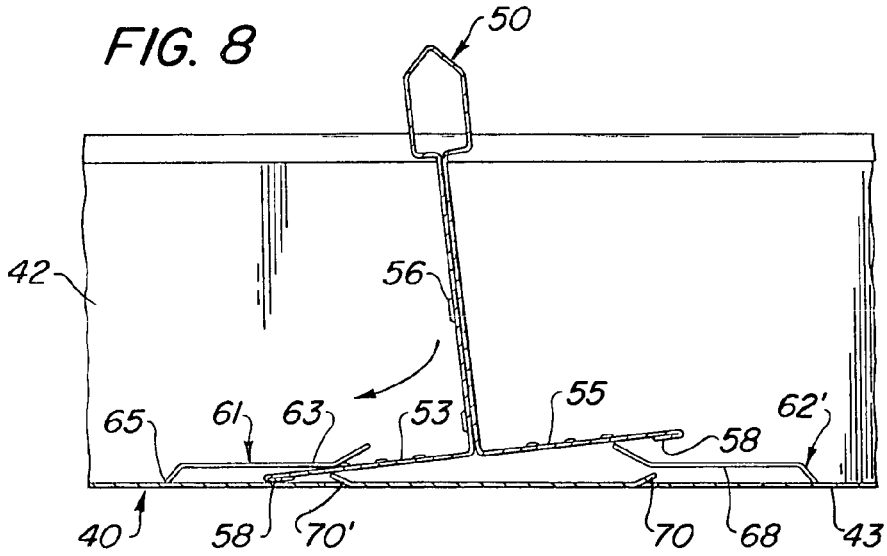
FIG. 8 is similar to FIG. 3 showing an embodiment wherein tab 61 has associated therewith a ratchet tooth 73, and tab 62 is as long as tab 61.
Figure 9:
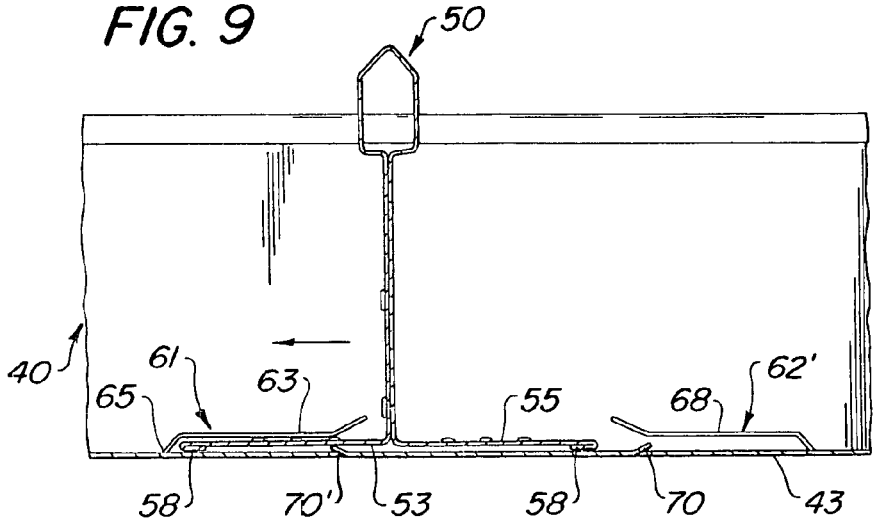
FIG. 9 is similar to FIG. 5 showing the beam 50 of FIG. 8 in a rearward position on the ledge.
Figure 10:
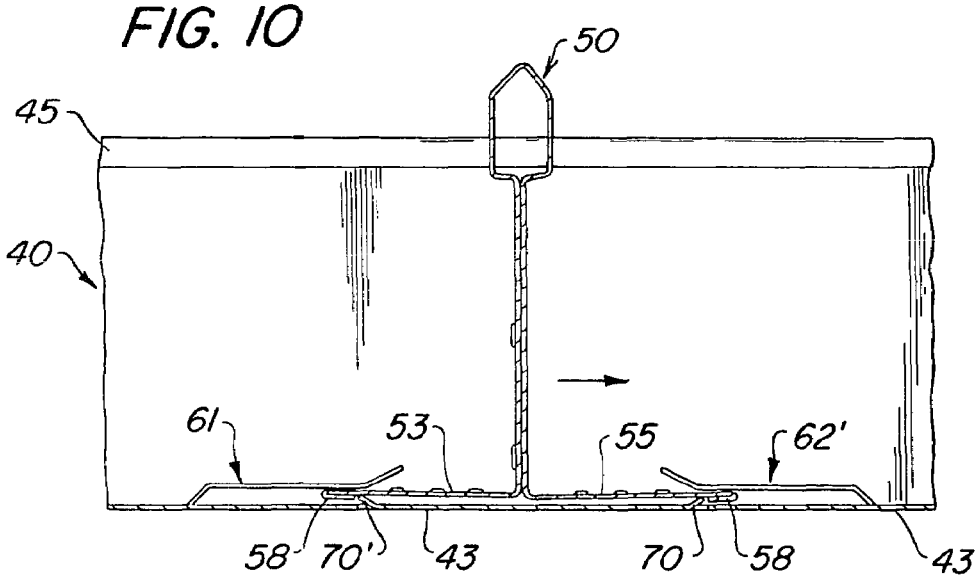
FIG. 10 is a view similar to FIGS. 7 and 10 showing the beam of FIG. 8 shifted forward to a locked position.

In an alternative embodiment of the invention, as seen in FIGS. 8 through 10, tab 62' is extended in length to that of tab 61, and an additional ratchet tooth 70' is formed alongside of the tab 61. In this embodiment, the beam can be positioned in the tabs by a first movement in either direction, that is, initially toward tab 61, or toward tab 62'.

Figure 11:
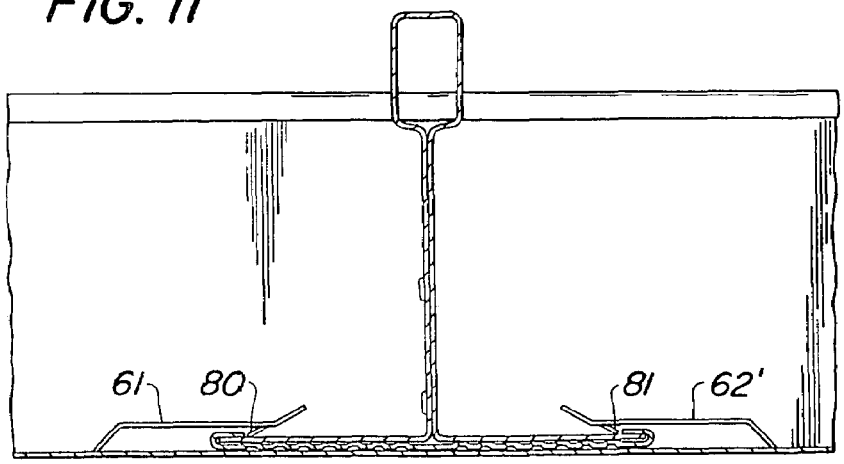
FIG. 11 is a view similar to FIGS. 7 and 10 showing a beam having an upward and inward hem secured in a pair of tabs with a ratchet tooth in each of the tabs.

As shown in FIG. 8, the first flange 53 can be first inserted under tab 61 until the hem 58 passes over ratchet tooth 70'. The beam 50 is then shifted, as seen in FIG. 9, in an opposite direction underneath tab 62' until the hem on the second flange 55 engages the ratchet tooth 70, as seen in FIG. 10. In this embodiment, the beam 50 is kept from shifting forward and rearward by the combined action of the ratchet teeth 70 and 71', and the tabs 61 and 62'. The flanges 53 and 55 are again downwardly secured against the ledge 43 by the downward spring bias of the tabs 61 and 62'.

Where a hem 58 of the beam 50, formed from a cap over the flanges, as shown in prior art in the '098 patent, and as seen in FIG. 11, extends upward and inward along the edges of the flanges, the embodiment of the present invention shown in FIG. 11 can be used. In this embodiment, the ratchet teeth 80 and 81 are formed in the tabs 61 and 62' and extend downwardly in a sloping fashion away from each other. Again, the beam 50 is positioned and secured within the tabs 61 and 62' by a back and forth motion whereby the beam 50 is locked and secured as shown in FIG. 11.

In the embodiments set forth above, the above described positioning and locking actions at the opposite end of beam 50 may occur simultaneously, if for instance, an installer is positioned at each end of the beam 50 to perform the position and securing action as described.

After a series of beams 50 are positioned and secured in the grid 23, as described, panels 25 of drywall are applied to the beam in the well-known prior art manner as, for instance, set forth in the '098 patent.

The panel 25 is held up against the grid 23 in a position where the edges of the panel 25 are against the wall molding ledge 43, or against a beam flange 53 or 55. The screws 26 are then power driven through the panel 25 edges into the indentations 57 on the beam, and into the ledge. The screw 26 heads are then driven to a seated position.

Generally, additional beams 50 are placed along the molding 40 in the manner set forth above, between the edges of a panel 25, and again, the panel is secured to these intermediate beams by self-tapping screws 26.

A pair 60 of tabs 61 and 62, and ratchet tooth 70 are regularly spaced along the molding ledge 43, so that beams can always be spaced 4' or 8' apart beginning at a wall 22 and progressing across the room to an opposing wall.

What is claimed is:

1. In a grid for a suspended drywall ceiling having (a) a wall molding extending rearward and forward along opposing parallel walls, with a vertical leg of the molding secured to the wall, and a ledge extending horizontally away from the wall, and (b) inverted T beams, each of the beams having,
to a bulb
a web extending downwardly from the bulb,
a first and second flange extending outwardly in opposite directions from the web at the bottom thereof,
and a hem extending along each outside edge of the first and second flange, with the beam supported on the ledges of the moldings on the opposing walls at opposite ends of the beams; the improvement comprising (a) a pair of downwardly biased tabs integral with, and lanced from, the horizontal ledge of the molding, for spacing and securing the ends of the beams to the molding, wherein the tabs have open ends extending toward one another, in combination with (b) a ratchet tooth on the molding.

2. The grid of claim 1 wherein the tabs comprise a rearward and a forward tab, and the beam is secured in the pair of tabs by sliding the first flange rearwardly beneath the rearward tab of the pair, and then sliding forward the second flange into the forward tab of the pair.

3. The grid of claim 2 wherein the ratchet tooth is formed adjacent to a tab and is lanced from the ledge.

4. The grid of claim 2 wherein the ratchet tooth is formed in a tab.

5. The grid of claim 2 wherein a ratchet tooth is formed adjacent to each tab, in the molding ledge.

6. The grid of claim 2, wherein a ratchet tooth is formed in each tab.

7. The grid of claim 1 wherein the ratchet tooth slopes upwardly.

8. The grid of claim 2 wherein the rearward tab is a hold-down tab, and the forward tab is a locking tab.

9. The grid of claim 3 wherein the locking tab and ratchet tooth lock the second flange of the beam onto the ledge so that the beam cannot move rearward or forward along the molding.

10. The grid of claim 1 wherein the ratchet tooth engages a hem that extends along the edge of a flange.

11. The grid of claim 1 wherein the ratchet tooth engages a hem that extends along the bottom edge of a flange.

12. The grid of claim 1 wherein the ratchet tooth engages a hem that extends along the top edge of a flange.

13. The grid of claim 5 wherein the pair of tabs which are formed at spaced intervals along the ledges of the moldings on opposite walls, are in registry with one another, so that the beams in the grid that extend from molding to molding are parallel to one another are formed at spaced intervals along the ledges of the moldings on opposite walls are in registry with one another, so that the beams in the grid that extend from molding to molding are parallel to one another.

14. The grid of claim 1 wherein the molding is rollformed and the tabs and the ratchet tooth are continuously formed during the rollforming.

15. In a wall molding for a grid in a suspended drywall ceiling, the molding having a right angle in its cross section with one side of the angle capable of being affixed to a wall, and the other side of the angle capable of serving as a ledge for supporting an inverted T beam having flanges that rests on the ledge, the beam having flanges with a downwardly extending hem extending along the edges of the flange, the improvement comprising (a) repetitive pairs of tabs extending at regular intervals along the edge for securing to the ledge an inverted T-beam with flanges, wherein the tabs are lanced from the ledge and extend toward one another in open position, and (b) a ratchet tooth lanced from the ledge, wherein, when the ledge supports a beam, the flanges of the beam are locked to the molding ledge by the tabs and the ratchet tooth.

16. The molding of claim 15 wherein the beam is secured in the pair of tabs by sliding the first flange rearwardly beneath a rearward tab of the pair, and then sliding forward the second flange into a forward tab of the pair.

17. The molding of claim 16 wherein the rearward tab is a hold-down tab, and the forward tab is a locking tab.

18. The molding of claim 15 wherein the locking tab and ratchet tooth lock a flange of the beam onto the ledge so that the beam cannot move rearwardly or forward along the molding.

19. The molding of claim 18 wherein the ratchet tooth engages a hem that extends along the bottom of the edge of a flange.

20. The molding of claim 18 wherein the ratchet tooth engages a hem that extends along the top of the edge of a flange.

21. The molding of claim 12 wherein the pair of tabs are formed at spaced intervals along the ledges of the moldings on opposite walls, and are in registry with one another, so that the beams in the grid that extend from molding to molding are parallel to one another.

22. The molding of claim 15 wherein the molding is rollformed, and the tabs and the ratchet tooth are continuously formed in the molding during the rollforming.

23. The molding of claim 15 wherein the molding is brake formed.

* * * * *

UNITED STATES PATENT AND TRADEMARK OFFICE

CERTIFICATE OF CORRECTION

PATENT NO. : 7,240,460 B2
APPLICATION NO. : 10/890436
DATED : July 10, 2007
INVENTOR(S) : William J. Platt It is certified that error appears in the above-identified patent and that said Letters Patent is hereby corrected as shown below:

Column 5, line 2, delete “to”.
Column 5, line 48, after “one another”, insert --.--.
Column 5, line 48 to and including line 51, delete “are formed at spaced intervals along the ledges of the moldings on opposite walls are in registry with one another, so that the beams in the grid that extend from molding to molding are parallel to one another.”

Signed and Sealed this

Twentieth Day of November, 2007

JON W. DUDAS
*Director of the United States Patent and Trademark Office*